US005725103A

United States Patent [19]

Yasuda et al.

[11] Patent Number: 5,725,103

[45] Date of Patent: Mar. 10, 1998

[54] BEND DETECTOR

[75] Inventors: Nobuyuki Yasuda; Masatoshi Yasuda, both of Osaka, Japan

[73] Assignee: Yutaka Works, Ltd., Osaka, Japan

[21] Appl. No.: 694,632

[22] Filed: Aug. 7, 1996

[51] Int. Cl.[6] ..... B07C 9/00

[52] U.S. Cl. ..... 209/691; 209/696; 209/707; 209/911; 209/932

[58] Field of Search ..... 209/598, 600, 209/691, 694, 696, 707, 911, 920, 932

[56] References Cited

U.S. PATENT DOCUMENTS

| | | | |
|---|---|---|---|
| 1,908,197 | 5/1933 | Tivendale et al. | 209/598 |
| 2,736,430 | 2/1956 | Ratti | 209/696 X |
| 3,385,433 | 5/1968 | Grimaldi et al. | 209/598 X |
| 3,623,604 | 11/1971 | Roberts | 209/598 X |
| 3,653,508 | 4/1972 | Tessmer, Jr. | 209/696 |

FOREIGN PATENT DOCUMENTS

| | | | |
|---|---|---|---|
| 405212358 A | 8/1993 | Japan | 209/598 |

*Primary Examiner*—D. Glenn Dayoan

*Attorney, Agent, or Firm*—William G. Lane, Inc., P.C.

[57] ABSTRACT

A bend detector for detecting a bend in headed rod members such as nails, screws, bolts, rivets and terminals. A guide plate, a base plate and a beam are mounted on a base which is being vibrated. Thus, a nail set in the bend detector is vibrated and rolls on the inclined edge of the guide plate and the base plate, which extends parallel to the edge of the guide plate. An air blower is provided under the head of the nail to lift it up from the edge of the guide plate by blowing air. If the nail is straight, it can roll smoothly on the edge of the guide plate and the base plate without its head disengaging from the edge of the guide plate even though it is lifted up from the edge of the guide plate by the air blower. If the nail is bent, its head will jump up until its shank abuts the beam when the crest of the bent portion faces downward while the nail is rolling. Its head will thus disengage from the edge of the guide plate, so that the nail will drop into the gap between the guide plate and the base plate.

3 Claims, 2 Drawing Sheets

BEND DETECTOR

BACKGROUND OF THE INVENTION

This invention relates to a bend detector for detecting a bend in headed elongated rod members with a shank, such as nails, screws, bolts, rivets and headed terminals as electronic parts.

Rod members of such a type are formed by unwinding a long wound wire, stretching it straight, cutting it into a plurality of pieces of a predetermined length, forming a head on each of the cut pieces, and hardening and/or plating them. The rod members thus formed are inspected to eliminate those whose tip shapes, lengths or head or shank diameters are out of standard.

Since these rod members are formed by stretching a wound wire and cutting it, they retain a tendency to curl. Thus, their end products include many bent ones which have to be eliminated as defectives. But currently, there is not known any method for directly detecting a bend in the shanks of such rod members. In conventional methods, a bend in a shank of such a rod member is detected not directly but by measuring a deviation in the length of each rod member or the diameter of its shank. But with this method, it is impossible to detect a slight degree of bend.

Also, it is impossible to tell whether the measured deviation in length or diameter reflects a bend in the rod member or an actual deviation in length or diameter. Thus, if the measured deviation in length or diameter of a rod member is larger than a predetermined value, such a rod member is automatically judged to be defective and eliminated even if it is not bent at all but is only slightly larger or smaller in length or diameter within a permissible range. Thus, with this method, even non-defective rod members were eliminated as defectives, so that the yield was low.

An object of this invention is to provide a bend detector which can detect a bend in headed rod members such as nails, screws, bolts, rivets or headed terminals as electronic parts with high efficiency and accuracy at high speed.

SUMMARY OF THE INVENTION

According to this invention, there is provided a bend detector for detecting headed rod members for bending, the bend detector comprising a first elongated member inclined in a longitudinal direction a second elongated member extending parallel to the first elongated member at a lower level than the first elongated member, the first and second elongated members being spaced from each other so that the headed rod members can roll and move on the first and second elongated members with their head caught on the first elongated member and their tip resting on the second elongated member, and an elongated beam provided so as to extend parallel to the first and second elongated members at a position between the first and second elongated members and spaced upwardly from the first and second elongated members by a distance slightly larger than the diameter of a shank of the headed rod member.

The elongated first and second members, and the elongated beams are inclined in parallel to one another with the second member provided at a lower level than the first member. The beam is spaced upwardly from the first and second members by a distance slightly larger than the headed rod member. Thus, if the rod is straight, it can roll on the first and second members with its head caught on the first member, its tip resting on the second member, and its tip slightly spaced from the overhead beam.

If the head rod is bent, its head will disengage from the first member while rolling, so that the rod member will drop into the gap between the first and second members.

Other features and objects of the present invention will become apparent from the following description made with reference to the accompanying drawings, in which:

DETAILED DESCRIPTION OF THE PREFERRED EMBODIMENT

The embodiment of this invention is described with reference to the accompanying drawings.

Figure 1:
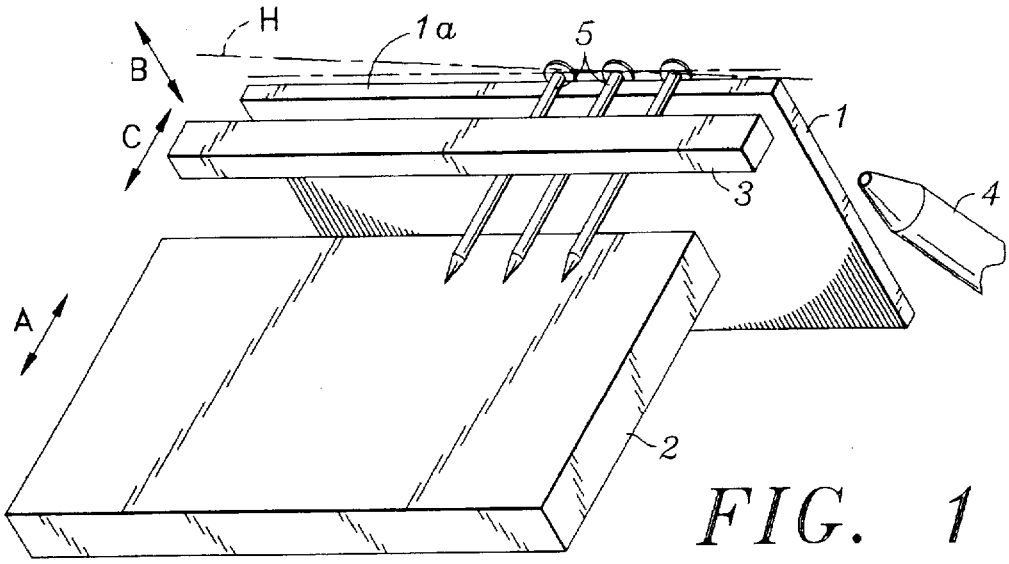
FIG. 1 is a schematic perspective view of one embodiment of the bend detector according to this invention.
Figure 2:
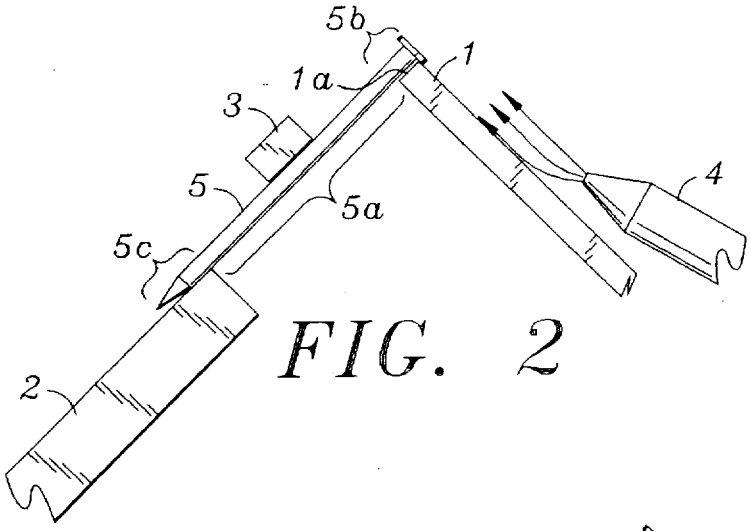
FIG. 2 is a side view of FIG. 1.

Referring first to FIGS. 1 and 2, the bend detector according to this invention comprises a guide plate 1, a base plate 2, a beam 3 and an air nozzle 4, which are mounted on a base (not shown).

The guide plate 1 is fixed with its edge 1*a* inclining obliquely downward toward its left end in FIG. 1. The base plate 2 is spaced from and arranged below and parallel to the edge 1*a* of the guide plate 1. It can be moved in the direction of arrow A and fixed at a position spaced from the edge 1*a* of the guide plate 1 by a predetermined distance which can be adjusted according to the length of nails 5.

The beam 3 is provided parallel to and between the edge 1*a* of the guide plate 1 and the base plate 2. It can be moved in the direction of arrow B and fixed at an adjustable position spaced upward by a predetermined distance from the edge 1*a* and the base plate 2. In the embodiment shown, the beam 3 is fixed at a position spaced upward from the edge 1*a* and the base plate 2 by a distance that is slightly larger than the diameter of the shank 5*a* of each nail 5.

Also, the beam 3 can be moved in the direction of arrow C and fixed at an adjustable position. After the base plate 2 has been moved in the direction of arrow A to a predetermined position and fixed in position, the beam 3 is moved in the direction of arrow C to a position at substantially equal distances from the edge 1*a* of the guide plate 1 and the base plate 2 and fixed in position.

The air nozzle 4 is provided behind the guide plate 1 and adapted to blow air at the heads 5*b* of the nails 5 to lift them out of contact with the edge 1*a* of the guide plate 1.

To inspect nails 5 for bending, they are set in the bend detector with their heads 5*b* caught on the edge 1*a* of the guide plate 1 and their tips 5*c* resting on the base plate 2. Since the base plate 2 is provided at a lower level than the edge 1*a* of the guide plate 1, the nails 5 are arranged inclining downward toward their tips 5*c*.

The base (not shown) carrying the guide plate 1, base plate 2 and beam 3 is being vibrated at all times, so that the nails 5 will be vibrated and roll on the edge 1*a* of the guide plate 1 and the base plate 2.

FIG. 2 shows a straight nail 5. Although the head 5*b* of this nail 5 is lifted off the edge 1*a* by the air nozzle 4, it remains caught on the edge 1*a* of the guide plate 1. The nail will thus roll smoothly on the edge 1*a* of the guide plate 1.

Figure 3:
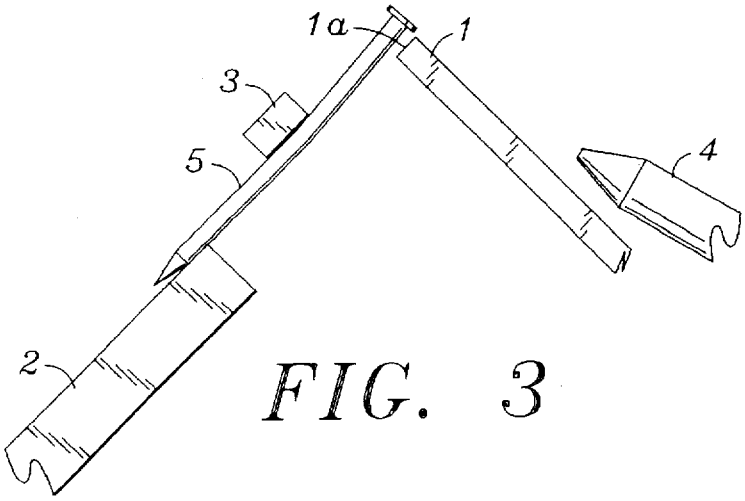
FIG. 3 is a view showing how the device of FIG. 1 is used.
Figure 4:
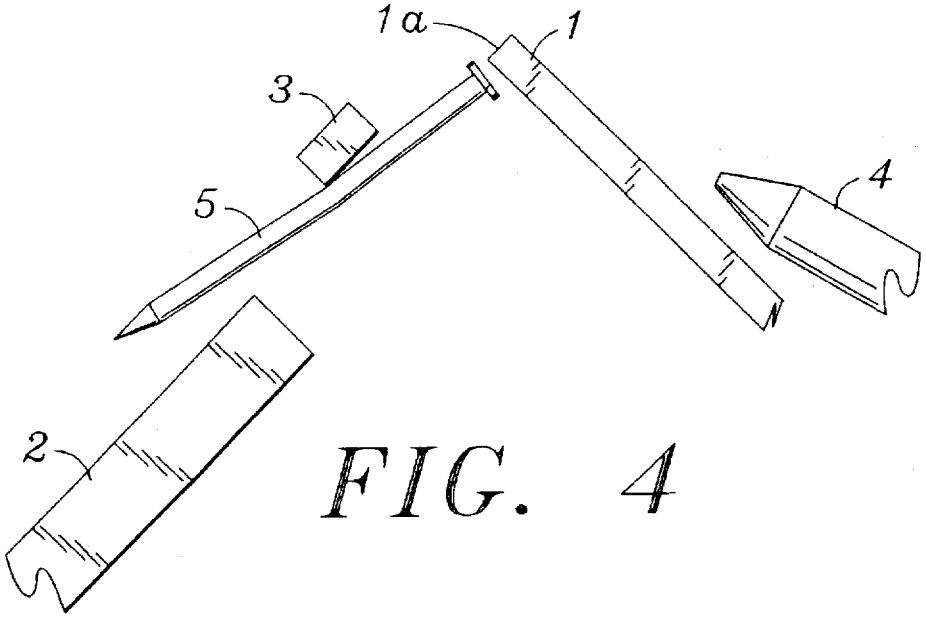
FIG. 4 is a view showing another operational state of the device of FIG. 1.
Figure 5:
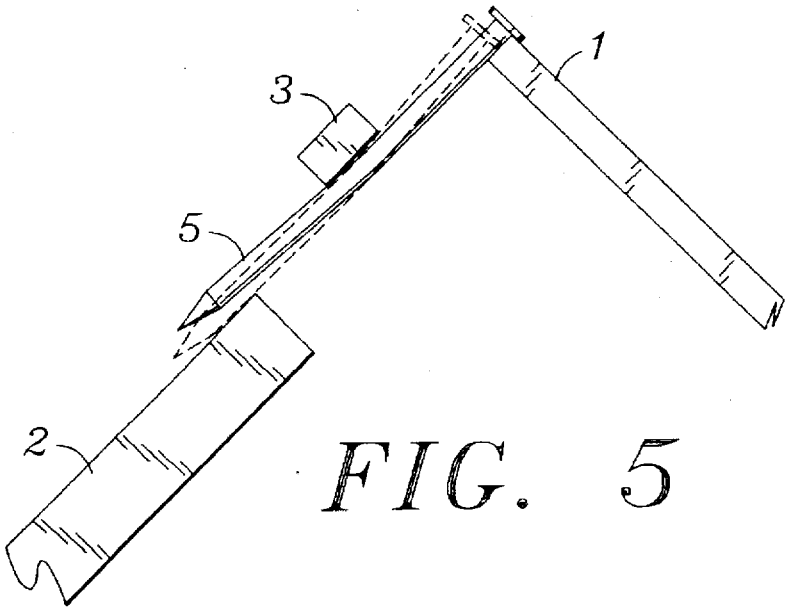
FIG. 5 is a side view of an alternate embodiment of the device shown in FIG. 1.

FIG. 3 shows a bent nail 5. When the crest of the bent portion in the shank 5*a* of the nail 5 faces downward while rolling, its head 5*b* will jump up until its shank 5*a* abuts the beam 3. Thus, the nail 5 will get off the edge 1*a* of the guide plate 1. Since the nail is inclined downward toward its tip 5*c*, the head 5*b* will slide past the edge 1*a* of the guide plate 1, so that the nail will drop into the gap between the guide plate 1 and the base plate 2.

In this way, any straight nail, i.e. a non-defective nail, rolls on the edge 1*a* of the guide plate 1 and the base plate 2 to the left end and is discharged from the bend detector, whereas any bent nail, i.e. a defective nail, drops into the gap between the guide plate 1 and the base plate 2. It is thus possible to separate defectives from non-defectives.

Since the heads 5*b* of the nails 5 are kept afloat by the air blown from the nozzle 4, it is possible to more easily drop any defective nail. But the nozzle may be omitted. Even without the nozzle, it is possible to disengage the head 5*b* of any defective nail 5 from the edge 1*a* of the guide plate 1 and drop such a defective nail into the gap between the guide plate 1 and the base plate 2 by vibrating the nail.

Also, the nails 5 may be rolled and moved not by vibrating them but by any other means. For example, they may be rolled and moved by blowing air against them.

The guide plate 1, base plate 2 and beam 3 are not limited in shape and size. The bend detector according to this invention can check the existence of bending not only in nails but also screws, bolts or any other headed rod members.

As described above, the bend detector according to this invention detects a bend in a headed rod member by rolling it on the first and second member with its head caught on the first member and its tip resting on the second member. If the rod is non-defective, i.e. straight, it can roll on the first and second members without dropping into the gap therebetween. If it is bent, i.e. defective, it will drop into the gap between the first and second members.

Thus, this device can detect a bend in a rod efficiently, accurately and quickly.

What is claimed is:

1. A bend detector for detecting headed rod members for bending, said bend detector comprising:

a first elongated member inclined in a longitudinal direction;

a second elongated member extending parallel to said first elongated member at a lower level than said first elongated member, said first and second elongated members being spaced from each other so that said headed rod members can roll and move on said first and second elongated members with their head caught on said first elongated member and their tip resting on said second elongated member, and an elongated beam provided so as to extend parallel to said first and second elongated members at a position between said first and second elongated members and spaced upwardly from said first and second elongated members by a distance slightly larger than the diameter of a shank of said headed rod member.

2. A bend detector as claimed in claim 1 further comprising a vibrating means for vibrating said headed rod member to roll and move said headed rod member.

3. A bend detector as claimed in claim 1 further comprising an air blowing means for blowing air at the head of said headed rod members from below to keep said headed rod members lifted up from said first elongated member.

* * * * *